United States Patent [19]

Talge et al.

[11] 4,100,917

[45] Jul. 18, 1978

[54] HYDROTHERAPY UNIT

[75] Inventors: Henry J. Talge, Leawood; Samuel L. McNair; Verne L. Zugenbuhler, both of Kansas City, all of Mo.

[73] Assignee: Dazey Products Co., Industrial Airport, Kans.

[21] Appl. No.: 733,231

[22] Filed: Oct. 18, 1976

[51] Int. Cl.[2] ..... A61H 9/00

[52] U.S. Cl. ..... 128/66; 4/180

[58] Field of Search ..... 128/66, 37; 4/180, 178

[56] References Cited

U.S. PATENT DOCUMENTS

| | | | |
|---|---|---|---|
| 1,210,929 | 1/1917 | Gruber et al. | 128/66 UX |
| 2,559,678 | 7/1951 | Schroeter | 128/66 X |
| 2,938,517 | 5/1960 | Friend | 128/66 |
| 3,067,739 | 12/1962 | Karlik | 128/66 |
| 3,267,936 | 8/1966 | Brady | 128/66 |
| 3,466,689 | 9/1969 | Aurelio et al. | 128/66 X |
| 3,474,469 | 10/1969 | Steltz | 4/178 |
| 3,820,173 | 6/1974 | Weller | 128/66 X |
| 3,961,382 | 6/1976 | Peterson | 128/66 |

*Primary Examiner*—Lawrence W. Trapp

*Attorney, Agent, or Firm*—Lowe, Kokjer, Kircher, Wharton & Bowman

[57] ABSTRACT

A whirlpool type hydrotherapy unit includes a centrifugal pump which circulates water in a tub. The pump has a pair of outlets, one of which is a primary outlet immersed in the water to provide a whirlpool effect. A vibrating spray head accessory may be attached to a secondary outlet to provide a water spray and accompanying massage. A large volume of air is induced by aspiration to mix in with the water that discharges into the tub from the primary outlet. The pump is driven by a battery powered D. C. motor which is controlled as to speed and time of operation by solid state controls. Special circuitry also prevents operation of the motor when the battery charger is coupled to an A.C. power supply or when the voltage of the battery falls below a specified value.

22 Claims, 10 Drawing Figures

HYDROTHERAPY UNIT

BACKGROUND AND SUMMARY OF THE INVENTION

This invention relates to an improved whirlpool type hydrotherapy unit which circulates water in a tub.

Portable water circulating units have achieved considerable success in recent years due to the pleasant, therapeutic effects imparted by the swirling water. Nevertheless, existing devices have not been entirely satisfactory in all respects, with the potential for electric shock being a major problem. Typically, standard A.C. household voltage is used to drive the electric motor of the pump assembly, and the risk of serious injury resulting from the units are further characterized by undue complexity, high manufacturing and operating costs, and cumbersome size and weight.

Even though the advantages of aerating the water as it is agitated have been recognized, existing units which provide for aeration have not done so in an altogether satisfactory manner. The major difficulty has been to supply air in great enough quantity to take full advantage of the aeration effect. Since it is normal for only a relatively small amount of air to be mixed in with the water, the air bubbles are rather small and the resulting aeration is not wholly effective.

The rate at which water is circulated by the pumps of existing units is usually not variable or at best is only variable in stepped fashion. Even in those units which do provide variable speed motors for variation of the pumping rate, the motor speed is not adjustable throughout a continuous range, but instead has only several discrete levels. Automatic control of the time during which the motor runs is also not provided in prior art units.

It is an important object of the present invention to provide a whirlpool type hydrotherapy unit that includes a primary outlet for circulating water in the tub and a secondary outlet to which an accessory may be attached for application of a water spray.

Another object of the invention is to provide a hydrotherapy unit of the character described in which the amount of water flow through the secondary outlet may be easily controlled.

Still another object of the invention is to provide a hydrotherapy unit which mixes a large quantity of air with the circulating water in order to maximize the aeration effect.

A further object of the invention is to provide a hydrotherapy unit which includes a novel storage tray that is conveniently located and easily opened and closed.

Yet another object of the invention is to provide a vibrating spray head accessory that produces a massaging effect along with a spray of water.

An additional object of the invention is to provide a hydrotherapy unit which is battery powered in order to substantially eliminate the risk of injury due to electrical shock.

A still further object of the invention is to provide a hydrotherapy unit in which the battery may be recharged without the possibility of shock from the A.C. power sourch used for charging. The automatic disabling of the motor control circuit when the battery charger is being used assures that household voltage A.C. will not be applied to the unit.

Another object of the invention is to provide a hydrotherapy unit of the character described which includes solid state controls for the timing and speed of the motor.

Still another object of the invention is to provide an automatic low voltage cutoff to prevent the battery from discharging below a preselected voltage level.

Other and further objects of the invention, together will the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are used to indicate like parts in the various views.

Figure 1:
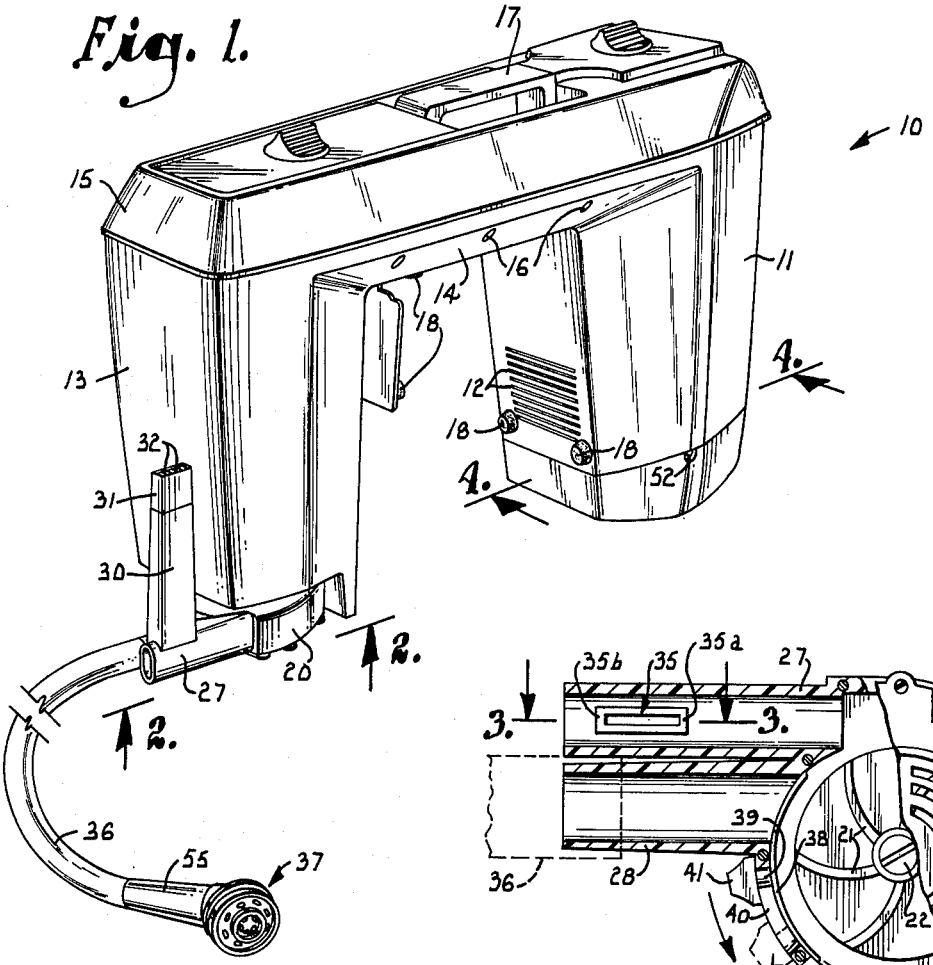
FIG. 1 is a perspective view illustrating a portable hydrotherapy unit constructed in accordance with the present invention.

With initial reference to FIG. 1, the hydrotherapy unit of the present invention has a frame or casing 10 which is in the general shape of an inverted U. One vertical leg 11 of the casing houses a rechargeable battery B (FIGS. 9 and 10) in the preferred embodiment. Leg 11 remains out of the tub during use of the device, and it is provided with air vents 12. The other vertical casing leg 13 is inserted in the bath tub (not shown) during use and is connected with leg 11 by an integral horizontal portion 14 of the casing. Portion 14 bridges over the rim of the tub during use. The casing has a top housing 15 which is secured to portion 14 by screws 16. The top housing 15 is equipped with a handle 17 for lifting and carrying of the unit. Pads 18 are provided on legs 11 and 13 and on portion 14 to cushion their engagement with the tub.

Figure 2:
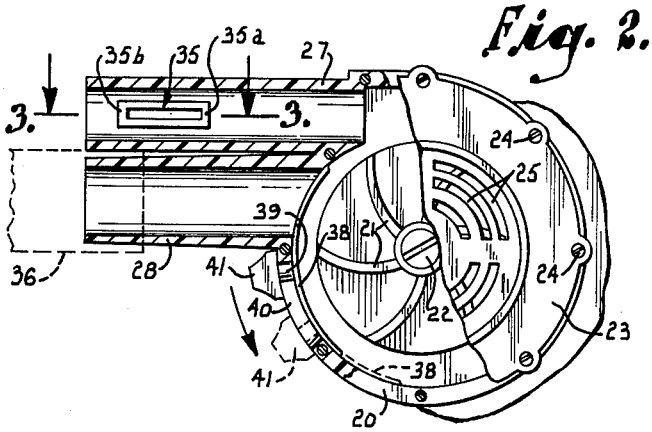
FIG. 2 is a fragmentary bottom plan view on an enlarged scale taken generally along line 2—2 of FIG. 1 in the direction of the arrows, with portions broken away for illustrative purposes.

A pump housing 20 for a centrifugal type pump is located on the lower end of leg 13 and is submerged in the water during use. With reference to FIG. 2 in particular, the pump housing 20 is generally circular and houses a rotary impeller 21 which has curved blades or paddles. The impeller is screwed at 22 to the lower end of a vertical shaft (not shown) which is driven by a D.C. motor M (FIG. 9) that is housed within leg 13 of the casing. A circular plate 23 is secured to the bottom of housing 20 by screws 24. A series of arcuate slots 25 are formed in plate 23 to provide inlets through which water is drawn into the pump housing.

The pump housing 20 has a pair of separate outlets 27 and 28 which extend laterally therefrom in side by side relation. Each outlet 27 and 28 is a generally cylindrical conduit which is preferably integral with the pump housing. Housing 20 is preferably mounted on leg 13 to pivot about a vertical axis so that the angular orientation of outlets 27 and 28 may be varied.

Figure 3:
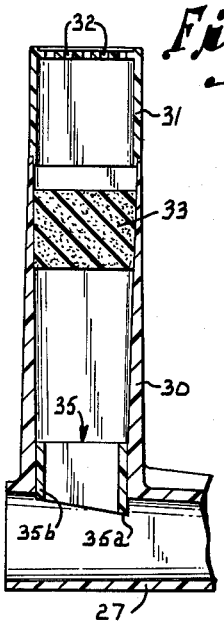
FIG. 3 is a fragmentary sectional view taken generally along line 3—3 of FIG. 2 in the direction of the arrows.

Outlet 27 is the primary outlet which normally discharges water for circulation in the tub. In order to provide air to mix with the water that discharges through outlet 27, a vertical air tube 30 extends upwardly from the outlet near its discharge end. With additional reference to FIG. 3, tube 30 is integral with outlet 27 at its lower end, and its upper end is provided with a cap 31 which has a plurality of slots 32 formed in its top surface. Slots 32 are located above the water level in the tub so that they are able to provide air which is to be mixed in with the water that flows through outlet 27. A sponge type muffler and diffuser element 33 is mounted within the cap 31. Element 33 muffles the sound of the air that flows through tube 30. Air is able to flow through element 33 at a relatively constant rate, while the muffler element prevents water from building up and squirting out of the air tube 30 through slots 32.

A hollow member 35 which serves to induce a large volume of air flow through tube 30 is fit within the air tube at its junction with outlet 27. The side and end walls of member 35 fit closely against the internal surfaces of tube 30 and are secured thereto, as best shown in FIG. 2. The hollow interior of member 35 presents a conduit which provides the sole communication between tube 30 and outlet 27. The lower end of member 35 is inclined in beveled fashion so that it creates a suction effect which induces a large volume air flow through tube 30 by aspiration. The upstream end wall 35*a* of member 35 projects well into outlet 27, and the lower edges of the side walls angle upwardly toward tube 30 as they extend downstream. The downstream end wall 35*b* of member 35 preferably terminates at approximately the top of outlet 27. Accordingly, the water flowing through outlet 27 strikes the upstream end wall 35*a* and is deflected around it such that a suction effect is created at the open lower end of member 35. The suction induces a large volume air flow into slots 32 and downwardly through tube 30 so that large air bubles are mixed in with the water which is discharged into the tub through outlet 27.

Outlet 28 is a secondary outlet from the pump housing, and it provides a means by which a flexible hose 36 may be attached to receive discharge water from the pump. As indicated in broken lines in FIG. 2, hose 36 fits tightly over the end of outlet 28, although it may be easily removed therefrom. An accessory such as a hand held spray head 37 is carried on the opposite end of hose 36. The details of spray head 37 will be described later in connection with FIGS. 5–8, and it is noted at this point that various other types of accessories may be attached to outlet 28 to receive water therefrom.

With reference to FIG. 2, a sliding gate valve 38 is mounted against the interior side surface of pump housing 20 in order to control the discharge of water through outlet 28. A short stud 39 extends from valve 38 outwardly through a narrow slot 40 which is formed in the side of the pump housing. The stud 39 has a knob 41 secured to its outer end. Knob 41 is larger than slot 40 and bears against the outer surface of housing 20 to retain valve 38 firmly against the interior surface thereof.

Knob 41 may be slid with the fingers in order to slide valve 38 between the open and closed positions shown in broken and solid lines in FIG. 2. In the open position, outlet 28 is fully exposed so that both it and outlet 27 discharge water in approximately equal amounts. In the closed position, valve 38 completely blocks outlet 28 to flow so that all of the water flows out through outlet 27. Valve 38 may be set in any intermediate position in which outlet 28 receives some discharge water although less than outlet 27. Slot 40 is completely covered by the valve at all positions of the latter.

Figure 4:
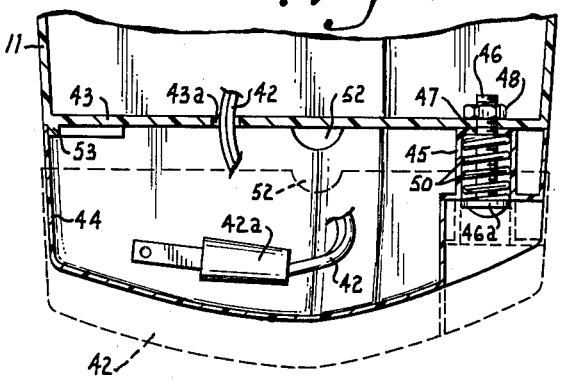
FIG. 4 is a fragmentary sectional view on an enlarged scale taken generally along line 4—4 of FIG. 1 in the direction of the arrows, with the broken lines indicating movement of the cord storage tray to a position from which it may be pivoted open.

As previously indicated, the drive motor M is preferably operated by battery B in order to reduce the potential for shock hazard. Alternatively, the motor may be an A.C. motor which requires connection to an A.C. power source. For this purpose, a cord 42 (FIG. 4) may be provided. The cord connects with the motor at one end and carries a standard plug 42*a* on its other end for connection with a conventional wall outlet.

Cord 42 extends downwardly through an opening 43*a* formed in a horizontal panel 43 which forms the floor of leg 11. A storage tray 44 provides a hollow compartment in which the cord 42 is stored when not in use. Tray 44 is mounted below panel 43 on the bottom end of leg 11. Near one of its sides, tray 44 is recessed upwardly from its bottom to provide a cavity area 45. The tray is mounted to panel 43 by a small screw 46 which is located in the cavity 45. Screw 46 extends through the top or roof portion 47 of cavity 45 and also through panel 43. A nut 48 is threaded onto the top end of screw 46 to attach tray 44 to panel 43.

A compression spring 50 acts to urge tray 44 upwardly at all times. The spring is fit around screw 46 to bear upwardly against roof 47 and downwardly against the enlarged screw head 46*a*. Tray 44 may be pulled downwardly against the force of spring 50 to the broken line position of FIG. 4, with cavity 45 being large enough to accommodate the screw head 46*a*. The tray can then be turned about the axis of screw 46 so that the compartment in which cord 42 is contained is opened to provide access for removal of the cord.

With the tray open, the entire length of cord 42 may be removed, and plug 42*a* may be connected to a wall outlet (not shown). Alternatively, plug 42*a* may be removed and the cord passed through a small, semicircular opening 52 which is formed in the upper edge of one side wall of the tray. The tray is then swung to the closed position, and only the length of cord necessary is drawn out of the tray through opening 52, the remainder of the cord being contained within the tray compartment.

A small lip 53 is formed to extend downwardly from panel 43 a short distance inwardly from its outer edge. The lip 53 contacts the upper interior portions of the tray side walls when tray 44 is closed. Thus, the tray will snap into its closed position with lip 53 assuring proper alignment. Opening of the tray requires it to be pulled downwardly far enough to clear lip 53 before it can be swung open.

Cord 42 is eliminated if the unit is battery powered as in the preferred embodiment, since there is then no need for A.C. power. In such case, the tray 44 may be employed for storage of accessories and the like.

The vibrating spray head 37 is illustrated in detail in FIGS. 5–8. Hose 36 fits tightly on the end of a neck portion 55 which accommodates the hand for holding of the spray head. Neck 55 gradually increases in size as it extends away from hose 36 to connection with the spray head 37. An internal partition 56 is formed at the junction between the spray head and its neck 55.

Figure 5:
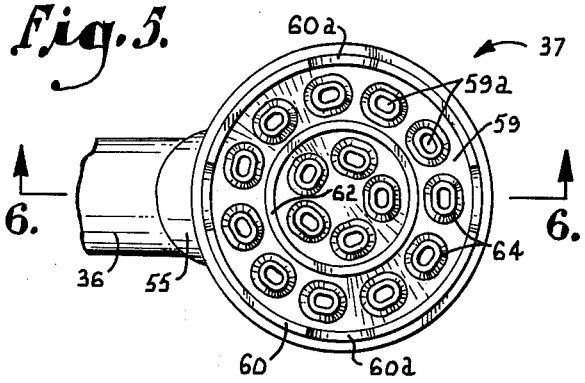
FIG. 5 is a plan view on an enlarged scale illustrating a vibrating spray head accessory which may be used with the hydrotherapy unit according to the invention.
Figure 6:
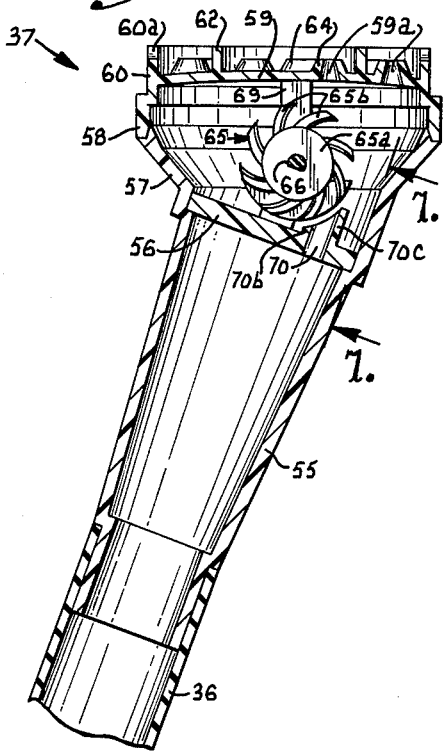
FIG. 6 is a cross sectional view taken generally along line 6—6 of FIG. 5 in the direction of the arrows.

With particular reference to FIG. 6, the spray head is a hollow structure which includes an outwardly flaring lower side wall 57 that joins with a circular side wall 58. An apertured face plate 59 is formed integrally with wall 58 and is provided with a plurality of apertures **59*a* that form outlets through which water is sprayed. A circular rim 60 which is essentially an outward continuation of wall 58 projects outwardly from the periphery of plate 59. A plurality of curved notches 60*a* (FIG. 5) are formed in the outer edge of rim 60. A circular flange 62 projects outwardly from plate 59 at a location inwardly of and concentric with rim 60**.

Apertures **59*a* are generally oval in section, and they extend through small bosses 64 which project outwardly from the surface of plate 59. As best shown in FIG. 6, apertures 59*a* taper as they extend outwardly through bosses 64, thereby providing streams or jets of water discharging from the spray head. Rim 60 and flange 62 project outwardly a greater distance than bosses 64. As shown in FIG. 5, there are a number of apertures formed between rim 60 and flange 62**, and a number located within the flange.

Figure 7:
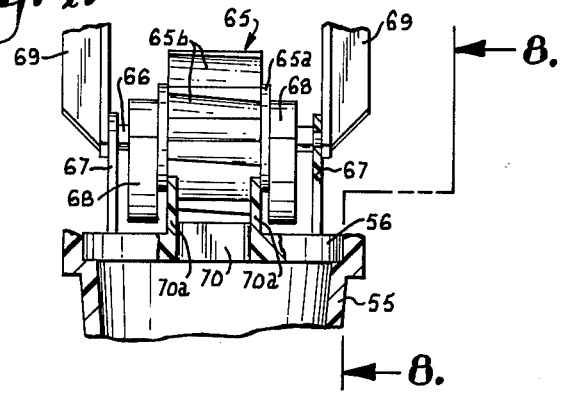
FIG. 7 is a fragmentary sectional view taken generally along line 7—7 of FIG. 6 in the direction of the arrows.

A paddle wheel 65 is mounted substantially centrally within the spray head. The paddle wheel includes a central sleeve portion **65*a* which is mounted on a shaft 66 for rotation therewith. Spaced bracket arms 67 extend into the spray head from partition 56 to rotatably support the shaft. A plurality of blades or paddles 65*b* are integral with sleeve 65*a* in outward projection therefrom. The paddles are curved to present concave surfaces against which the water is directed. The outer edges of paddles 65*b* are angled slightly relative to the axis of shaft 66, as best shown in FIG. 7**.

At the opposite ends of the paddle wheel, a pair of eccentric weights 68 are carried on shaft 66. The eccentricity of members 68 causes the shaft to be unbalanced as it rotates such that the spray head vibrates and thus imparts a massaging effect along with the water spray. A pair of bracket arms 69 project inwardly from plate 59 and connect with arms 67 to strengthen the mounting of the paddle wheel.

Figure 8:
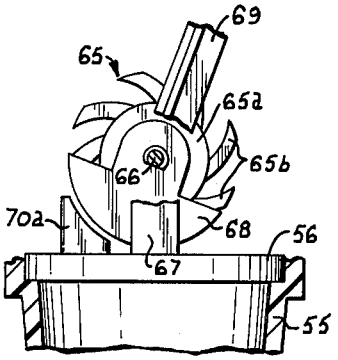
FIG. 8 is a fragmentary view taken generally along line 8—8 of FIG. 7 in the direction of the arrows.

A slot 70 is formed through partition 56 to direct the water against the concave surfaces of paddle **65*b*. Around the periphery of the slot, side walls 70*a* (FIG. 7) and end walls 70*b* and 70*c* (FIG. 6) project from partition 56 toward the paddle wheel. As best shown in FIG. 8, the outer edges of the walls conform generally with the curved periphery of the paddle wheel, and there is only a short distance presented between the wall edges and the paddle edges. Therefore, substantially all water that passes through the spray head is directed against paddles 65*b***.

Figure 9:
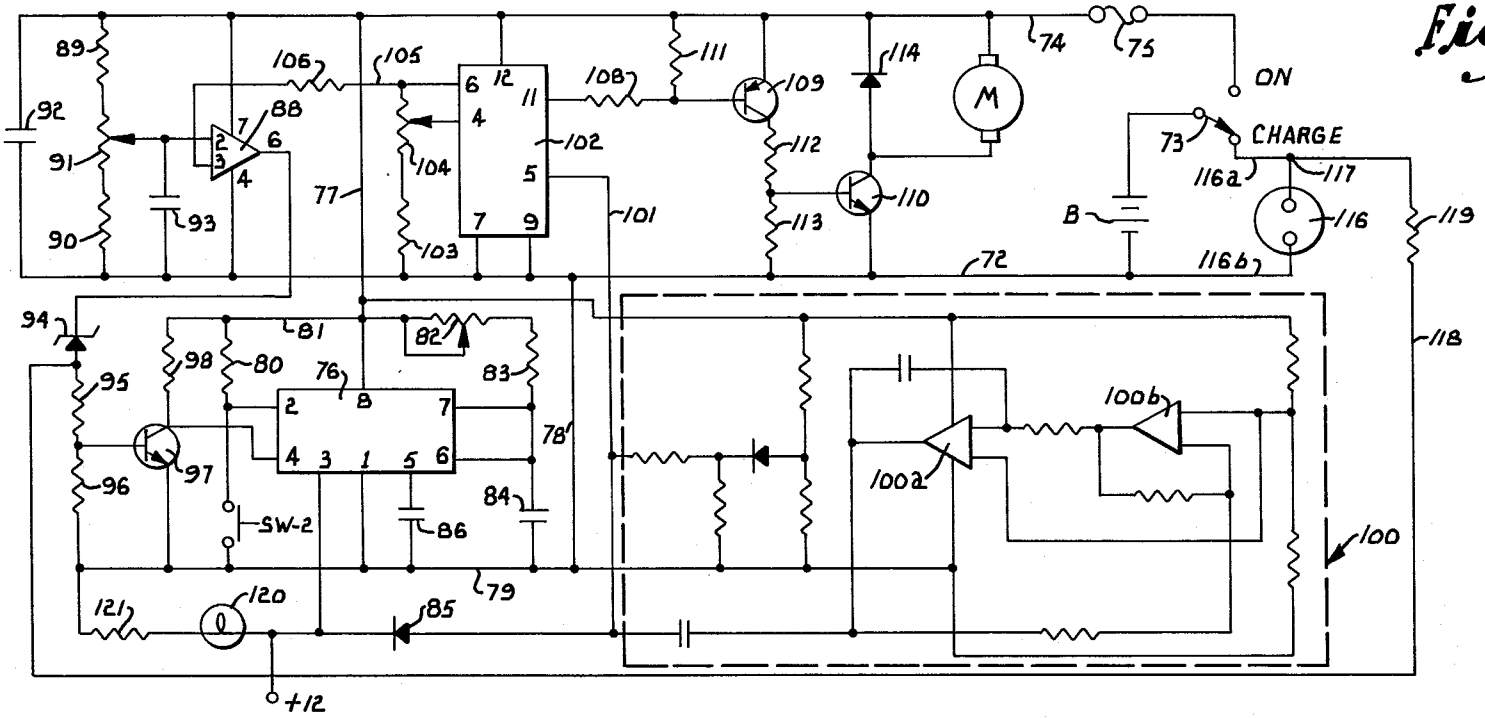
FIG. 9 is a circuit diagram illustrating the motor controls for the hydrotherapy unit.

Referring now to FIG. 9, the unit is provided with control circuitry which controls the speed and timing of motor M, as well as providing an automatic low voltage cutoff which disables the circuit if battery B drops below a preselected voltage level. The negative terminal of the battery connects with a common line 72, while a switch 73 connects the positive side of the battery with line 74 when the switch is in the "on" position. Line 74 is tied to one side of motor M and is provided with a fuse 75.

The timing controls for the motor include a 555 precision timing integrated circuit 76 which acts as a monostable multivibrator. Line 77 connects line 74 with pin 8 of circuit 76, and lines 78 and 79 connect the common line 72 with the ground pin 1 of the timing circuit. A pull up resistor 80 and a normally open push button switch SW-2 are tied between line 79 and a line 81 that connects with line 77. Triggering of circuit 76 is effected by an external signal applied to an input pin 2 which is tied in between resistor 80 and switch SW-2.

The time constant for circuit 76 is determined by a variable resistor 82, a fixed resistor 83, and a capacitor 84 which are tied between lines 77 and 79. Resistor 83 is a current limiting resistor which has a resistance value much less than that of resistor 82 and thus has a negligible effect on the time constant. The resistance value of resistor 82 may be varied by turning a timing dial which is located on top of the hydrotherapy unit.

Pins 6 and 7 are control pins for circuit 76 which connect between resistor 83 and capacitor 84. Pin 3 is the output pin of the timing circuit which provides an output signal through a protection diode 85 that prevents negative signals from reaching pin 3. Pin 4 is a reset pin, as will be explained more fully, while pin 5 is grounded to line 79 through a filter capacitor 86.

A 741 integrated circuit 88 provides the low voltage cutoff function of the control circuitry. Pin 7 of circuit 88 is tied to line 74 and pin 4 is grounded to the common line 72. Fixed resistors 89 and 90 along with a variable resistor 91 form a voltage divider which connects between lines 72 and 74. One input to circuit 88 is applied to pin 2 thereof from resistor 91, and the other input is delivered to pin 3, as will be explained in more detail. The resistance value of resistor 91 is set according to the desired voltage level at which the circuit is to be disabled. Capacitors 92 and 93 serve to filter out noise.

Pin 6 delivers the output of circuit 88 to a Zener diode 94 which controls the output voltage. The Zener diode connects with a voltage divider made up of resistors 95 and 96. A transistor 97 has its base connected between resistors 95 and 96 to receive the output signal from circuit 88. The output of transistor 97 is applied to the reset pin 4 of the timing circuit 76. A resistor 98 connects with the collector electrode of transistor 97.

Turning now to the speed control circuitry for the motor, a conventional 5 KHz. oscillator 100 applies output pulses to line 101, which also receives an output from pin 3 of the timing circuit 76. Included in oscillator 100 are a pair of operational amplifiers **100*a* and 100*b* which together form a 1458 integrated circuit. Line 101 leads to one input pin 5 of a 723 integrated circuit 102. A second input to circuit 102 is applied to pin 4 thereof through a fixed resistor 103 and a variable resistor 104 which are tied between the common line 72 and an output line 105. Line 105 leads from an output pin 6 that provides a constant voltage output from circuit 102. Line 105 is provided with a biasing resistor 106 and leads to the second input pin 3 of circuit 88. Pin 4 of circuit 102 provides the controlling input for the motor speed, and the resistance value of resistor 104** may be varied by turning a speed dial which is located on top of the hydrotherapy unit.

Pins 7 and 9 of circuit 102 are grounded to common line 72, and pin 12 connects with line 74. An output pin 11 applies output pulses from circuit 102 through a resistor 108 to a three amp transistor 109 which in turn controls a 15 amp transistor 110. A resistor 111 connects from line 74 between resistor 108 and transistor 109. The base current to transistor 110 is supplied from transistor 109 through a resistor 112, while a base bias resistor 113 connects to common line 72. The output of transistor 110 is applied to motor M to control its speed. An inductive protection diode 114 is connected in parallel with motor M for protective purposes.

A jack 116 has terminals from which conductors **116*a* and 116*b* lead and connect with the opposite sides of battery B when switch 73 is in the "charge" position. The positive side of the battery and one terminal of jack 116 connect at node 117 with a conductor line 118 that includes a disable resistor 119. Line 118 leads to connection between the Zener diode 94 and resistor 95 in order to deliver a signal to transistor 97 whenever switch 73 is in the "charge" position, and also whenever jack 116** is connected with an external power source.

A pilot light 120 and resistor 121 connect with +12 volts so that the light goes on whenever switch 73 is in the "on" position. Light 120 thus gives an indication that the unit is on the drawing current from battery B.

In use, leg 13 is inserted in the bathtub to immerse pump housing 20 in the water. The unit is then turned on to activate motor M at the speed and for the time period set on the motor controls. The rotary motion of impeller 21 draws water in through the inlet slots 25 and discharges it through one or both outlets of the pump housing. If the gate valve 38 is closed, outlet 28 is blocked and all of the water flows through outlet 27 and circulates in the tub to provide a whirlpool effect. The suction created by the flow of water through outlet 27, in conjunction with the action of member 35, induces a large volume of air to enter slots 32 and to flow downwardly through tube 30. The air mixes with the water flowing through outlet 27, and the large air bubbles that result create a pleasant aeration effect of the circulating water. Muffler element 33 muffles the sound of the air that flows through tube 30 to eliminate what would otherwise be a harsh whistling sound caused by the large volume air flow.

If the spray head 37 or another type of accessory is to be used, valve 38 is opened fully or partially to permit water flow through outlet 28 in the quantity desired. The water flows through hose 36 and into the spray head through slot 70. The slot directs substantially all of the water against the concave surfaces of paddles **65*b*, and paddle wheel 65 is rotated by the water forces that are exerted against the paddles. Since shaft 66 is unbalanced as it rotates due to the eccentricity of members 68, the entire spray head vibrates to provide a massaging effect when held against the body. At the same time, a water spray is applied as the water discharges through apertures 59*a* in a plurality of small streams. Ordinarily, the spray head will be held with rim 60 and flange 62 against the body, and notches 60*a* provide access for the water to flow outwardly through rim 60**.

As the unit operates, the speed at which motor M runs is determined by the setting of resistor 104, and the time that the motor runs depends on the setting of resistor 82. With switch 73 in the "on" position, switch SW-2 is pushed to initiate operation of the motor. The input thereby applied to pin 2 of circuit 76 turns on the timing circuit, and capacitor 84 begins to charge through resistors 82 and 83 for the time period selected according to the setting of resistor 82. As the capacitor is being charged, circuit 76 remains on to provide an output at pin 3 which is applied through diode 85 to line 101. The output pulses of oscillator 100 are also applied to line 101 as a component of the signal that is delivered to the input pin 5 of circuit 102.

The input signals on pins 4 and 5 of circuit 102 result in constant amplitude square wave output pulses at pin 11 thereof. These pulses are applied to transistors 109 and 110 to control the motor speed. The pulse repitition frequency depends on the input signal applied to pin 4 which in turn depends on the setting of resistor 104. The output from pin 11 pulsee transistors 109 and 110 on and off to drive motor M at a speed which depends on the average voltage level delivered at pin 11, or in effect the pulse repitition frequency since the pulse amplitude is constant. Therefore, the motor speed is controlled in accordance with the setting of resistor 104.

Pin 6 of circuit 102 provides on line 105 a constant reference voltage which is applied to pin 3 of circuit 88. Normally, this reference voltage will be less than the voltage delivered to pin 2 from the battery, so that there is normally no output at pin 6. However, the voltage to pin 2 drops as the battery voltage drops, and when the voltage at pin 2 drops below that at pin 3, circuit 88 provides an output signal at pin 6 to indicate that the battery voltage has dropped below the selected level which depends on the setting of resistor 91. The Zener diode 94 assures that the signal from pin 6 is above a preselected voltage level. When the signal is applied through resistor 95 to turn transistor 97 on, the reset pin 4 of circuit 76 is grounded and the timing circuit goes off. The output signal at pin 3 of circuit 76 is then discontinued, and diode 85 is effectively grounded, as is oscillator 100. Accordingly, there is no signal applied to pin 5 of circuit 102, and motor M is deenergized automatically when battery B has discharged below the voltage level selected according to the setting of resistor 91.

Circuit 76 also goes off when capacitor 84 has fully charged. The input signal to circuit 102 is thereby discontinued to deenergize motor M when the time period that is set on resistor 82 has elapsed. The unit can be turned on to operate for a second time period by pushing switch SW-2 to repeat the cycle. The unit can be turned off at any time by moving switch 73 from the "on" position to the "charge" position wherein the positive side of battery B is disconnected from line 74 and connected with line 118. Transistor 97 is then turned on to ground pin 4 and thus disable circuit 76. In addition, connection of an external power source to jack 116 disables the circuit since the power source then applies current to node 117 and line 118 to turn on transistor 97.

Figure 10:
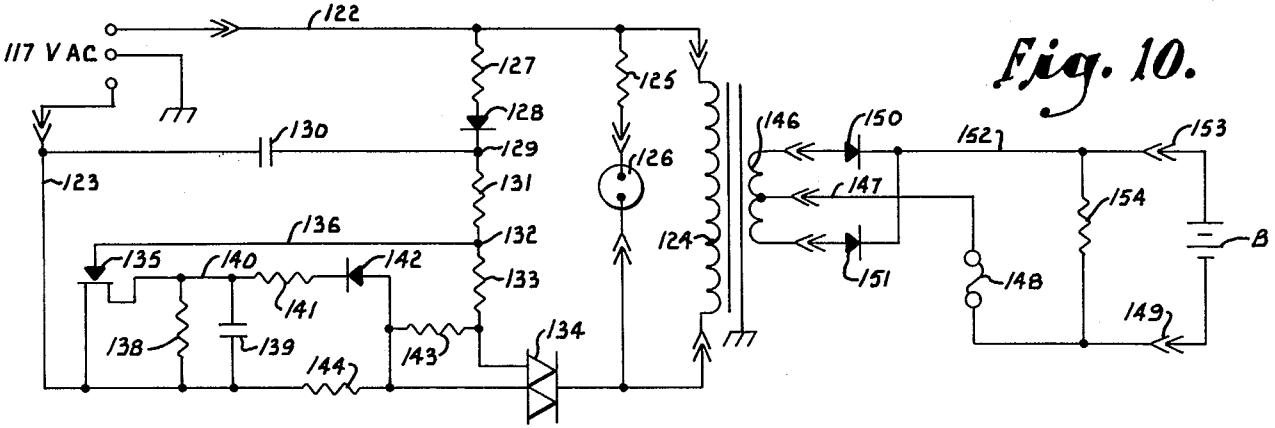
FIG. 10 is a circuit diagram illustrating the battery charger circuit.

Referring now to FIG. 10, a battery charger for charging battery B has a primary circuit that includes A.C. lines 122 and 123 which are connectable to a wall outlet to provide alternating current. Line 122 leads to the primary transformer winding 124, across which a resistor 125 and pilot light 126 are wired such that the light will indicate when the charger is operating. A resistor 127 and diode 128 are connected between line 122 and a node 129, and a capacitor 130 is tied between node 129 and line 123. A resistor 131 is wired between node 129 and another node 132. A resistor 133 is connected between node 132 and the triggering gate of a triac 134. The triac connects line 123 with the primary transformer winding 124.

The anode of an SCR 135 is connected to a line 136 that connects with node 132. The SCR 135 has a signal circuit which includes a resistor 138 and capacitor 139 that are tied between line 123 and a line 140 leading from the cathode of the SCR. Included in the signal circuit are a resistor 141 and a diode 142 which are located in line 140 beyond its connection with capacitor 139. A resistor 143 is connected between line 140 and the line leading to the triggering gate of triac 134. Line 123 is provided with a sensing resistor 144.

The secondary circuit of the battery charger includes a secondary transformer winding 146 which is center tapped by a line 147 which has a fuse 148. Line 147 leads to a connector 149 for the negative side of the battery. The secondary circuit is a four way bridge having diodes 150 and 151 connected with the ends of winding 146 and with a common line 152 that leads to a connector 153 for the positive side of the battery. A load resistor 154 is tied between lines 147 and 152.

The connectors 149 and 153 are preferably incorporated in a polarized plug which may be connected with the jack 116 shown in FIG. 9. The polarized plug assures that the charger will be connected properly relative to the battery, and fuse 148 also provides protection for the circuit. Switch 73 (FIG. 9) must be in the "charge" position in order to charge the battery, and it is again pointed out that in this position the circuit is disabled due to the application of current to line 118 and the resultant grounding of pin 4 of circuit 76. In addition, any time the battery charger is plugged into jack 116 and connected with an A.C. source, the circuit is disabled in the same fashion.

With switch 73 in the "charge" position and with the battery charger plugged into jack 116 and into a wall outlet, triac 134 is normally on so that voltage is applied across the transformer for charging of the battery. In the event of a short circuit on the secondary side, the current on the pimary side increases and the increase is sensed in resistor 144. The increased voltage through resistor 141 at its junction with resistor 138 becomes high enough to turn on the SCR 135. The SCR then shorts out the junction of resistors 131 and 133 at node 132 to turn off the triac 134. This breaks the connection of line 123 with the primary transformer 124, and the circuit remains disabled until the triac goes on again. The triac thereby provides short circuit protection for the secondary side of the battery charger.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described our invention, we claim:

1. Hydrotherapy apparatus for circulating water in a tub, said apparatus comprising:

a frame;

a pump housing mounted on said frame at a location to be immersed in the water, said pump housing having an inlet for receiving water and first and second outlets for discharging water, said first outlet directing water into the tub for circulation therein;

an accessory operable to receive and apply the water from said second outlet;

means for coupling said accessory with said second outlet to receive water therefrom;

an air tube disposed in communication with said first outlet to deliver air thereto, said air tube having an air inlet located above the water level in the tub for receiving air; and a hollow aspirating member located partially in said air tube and presenting a conduit which provides communication between said air tube and first outlet, said member having an upstream portion and a downstream portion, said upstream portion projecting into said first outlet a greater distance than said downstream portion, whereby suction is caused by water flowing through said first outlet to induce air flow through said air tube and into said first outlet by aspiration.

2. Apparatus as set forth in claim 1, including valve means for controlling the discharge of water through said second outlet.

3. Apparatus as set forth in claim 1, including:

an air tube disposed in communication with said first outlet to deliver air thereto, said air tube having an air inlet located above the water level in the tub for receiving air; and a muffler element disposed in said air tube for muffling the sound of air passing therethrough.

4. Hydrotherapy apparatus for circulating water in a tub, said apparatus comprising:

a frame;

a pump housing mounted on said frame at a location to be immersed in the water, said pump housing having an inlet for receiving water and first and second outlets for discharging water, said first outlet directing water into the tub for circulation therein;

an accessory operable to receive and apply the water from said second outlet;

means for coupling said accessory with said second outlet to receive water therefrom;

a cord adapted for connection with an electrical power supply; and a cord storage compartment for storing said cord, said storage compartment being supported on said frame for movement between an open position wherein the compartment is accessible and a closed position wherein the compartment is substantially inaccessible.

5. Apparatus as set forth in claim 4, including yieldable means urging said storage compartment toward its closed position.

6. Hydrotherapy apparatus for circulating water in a tub, said apparatus comprising:

a frame;

a pump housing mounted on said frame at a location to be immersed in the water, said pump housing having an inlet for receiving water and first and second outlets for discharging water, said first outlet directing water into the tub for circulation therein;

a spray head operable to receive and apply the water from said second outlet;

an elongate hose extending to said spray head from said second outlet;

a continuously symmetrical paddle wheel mounted for rotation within said spray head and operable to rotate in response to the force of water flow against the paddle wheel; and an eccentric member coupled with said spray wheel at the side thereof for rotation therewith to vibrate said spray head upon rotation of said paddle wheel.

7. Apparatus for applying a water spray, said apparatus comprising:

a spray head having an inlet adapted to receive a flow of water and a plurality of apertures providing an outlet for discharging the water in a spray;

a continuously symmetrical paddle wheel mounted for rotation in said spray head, said paddle wheel including a plurality of paddles disposed in the path of the water flow to effect rotation of said wheel; and an eccentric member coupled with said paddle wheel at the side thereof to unbalance same, thereby to vibrate said spray head upon rotation of said wheel.

8. Apparatus as set forth in claim 7, wherein said vibrating means includes:

a paddle wheel mounted for rotation in said spray head, said paddle wheel including a plurality of paddles disposed in the path of the water flow to effect rotation of said wheel; and an eccentric member coupled with said paddle wheel to unbalance same, thereby to vibrate said spray head upon rotation of said wheel.

9. Apparatus as set forth in claim 7, wherein each of said paddles is curved in a manner to present a concave surface facing toward the water flow, and including a slot presented within said spray head to direct the water against said concave surfaces of the paddles.

10. In a hydrotherapy unit having a pump for circulating water in a tube and an electric motor for driving the pump, a motor control circuit comprising:

a pulse generator coupled with said motor and operable to apply pulses of substantially constant amplitude thereto to drive the motor at a speed that varies with the frequency of said pulses;

a pulse frequency regulator operable to apply a first signal to said pulse generator that controls the frequency of said pulses, said pulse frequency regulator being adapted for connection with a power source to receive power therefrom; and means for adjusting said pulse frequency regulator to vary said first signal in a manner to vary the frequency of said pulses, thereby varying the speed of said motor.

11. The control circuit of claim 10, including:

a battery coupled with said pulse generator and frequency regulator to supply power thereto; and means for disabling said pulse generator when said battery has discharged below a preselected voltage level.

12. The control circuit of claim 10, including:

a timing circuit coupled with said pulse generator and operable to apply a second signal thereto, said pulse generator operable in response to the presence of both said first and second signals to apply said pulse to the motor;

means for applying power to said timing circuit; and adjustment means associated with said timing circuit for disabling same after a preselected time has elapsed, thereby discontinuing said second signal after the elapse of said preselected time.

13. The control circuit of claim 12, including oscillator means for delivering substantially constant frequency pulses to said pulse generator as a component of said second signal.

14. The control circuit of claim 12, including:

a battery coupled with said pulse generator, frequency regulator and timing circuit to supply power thereto; and means for disabling said timing circuit to discontinue said second signal when said battery has discharged below a preselected voltage level.

15. Portable hydrotherapy apparatus for circulating water in a tub, said apparatus comprising:

a frame having first and second leg portions spaced apart from each other;

a pump housing mounted on the first leg portion of said frame at a location to be immersed in the water, said pump housing having an inlet for receiving water and an outlet for discharging water into the tub for circulation therein;

a pump supported in said pump housing for drawing water in through said inlet and forcing the water out through said outlet;

an electric motor supported on the first leg portion of said frame for driving said pump; and a battery supported on the second leg portion of said frame and coupled with said motor to apply electric current thereto.

16. Apparatus as set forth in claim 15, including:

a circuit coupling said battery with said motor; and means for disabling said circuit to deenergize said motor when the battery has discharged below a preselected voltage level.

17. Apparatus as set forth in claim 16, wherein said disabling means comprises:

a voltage comparator operable to receive and compare a first input voltage with a second input voltage and to provide an output signal disabling said circuit when said second input voltage drops below said first input voltage;

means for applying a substantially constant reference voltage to said voltage comparator to provide said first input voltage thereto; and means for applying a variable voltage to said voltage comparator to provide said second input voltage thereto, said variable voltage varying in accordance with the voltage level of said battery.

18. Apparatus as set forth in claim 15, including:

a pair of terminals for said battery adapted for coupling with an external power source for charging the battery;

a circuit coupling said battery terminals with said motor to drive the battery; and means for disabling said circuit whenever external power is applied to said battery terminals.

19. A battery charger comprising:

a primary circuit adapted for connection to a power source to receive power therefrom;

a secondary circuit adapted for connection to a battery to deliver power thereto for charging of the battery;

a transformer coupling said primary and secondary circuits; and disabling means for disconnecting said primary circuit from said transformer in response to a short in said secondary circuit.

20. The battery charger set forth in claim 19, wherein said disabling means includes:

a triac connecting said primary circuit with said transformer to normally deliver current therebetween;

means for sensing a current increase above a preslected level in said primary circuit; and means for disabling said triac to disconnect said primary circuit from said transformer in response to the sensing of a current increase above said preselected level in said primary circuit.

21. In a hydrotherapy unit having a pump for circulating water in a tub and an electric motor for driving the pump, a motor control circuit comprising:

a timing circuit comprising a 555 integrated circuit adapted for connection with a power source and operable to provide an output signal;

means for applying current to said motor in response to said output signal; and adjustable means associated with said timing circuit for disabling same after a brief selected time has elapsed, thereby discontinuing said output signal and the application of current to said motor after the elapse of said preselected time.

22. In a hydrotherapy unit having a pump for circulating water in a tub and an electric motor for driving the pump, a motor control circuit comprising:

a timing circuit adapted for connection with a power source and operable to provide an output signal;

means for applying current to said motor in response to said output signal;

adjustable means associated with said timing circuit for disabling some after a preselected time has elapsed, thereby discontinuing said output signal and the application of current to said motor after the elapse of said preselected time;

a battery coupled with said timing circuit to supply power thereto; and means for disabling said timing circuit to discontinue the output signal thereof when said battery has discharged below a preselected voltage level.

* * * * *